US011151963B1

(12) United States Patent
Dai et al.

(10) Patent No.: US 11,151,963 B1
(45) Date of Patent: Oct. 19, 2021

(54) RESIDUAL IMAGE DETECTION METHOD AND APPARATUS OF DISPLAY PANEL

(71) Applicant: Xiamen Tianma Micro-Electronics Co., Ltd., Xiamen (CN)

(72) Inventors: Jiafeng Dai, Shanghai (CN); Ronghua Li, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/130,611

(22) Filed: Dec. 22, 2020

(30) Foreign Application Priority Data

Sep. 28, 2020 (CN) ..... 202011045293.7

(51) Int. Cl.
*G09G 3/10* (2006.01)
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0646* (2013.01); *G09G 2320/0666* (2013.01)

(58) Field of Classification Search
CPC ..... G06F 3/011; G06F 3/016; G06F 3/0346; G06F 2111/04; G06F 30/00; G06F 30/17; G06F 3/1446; G06F 3/147; A61B 34/10
See application file for complete search history.

(56) References Cited

U.S. PATENT DOCUMENTS 5,007,715 A * 4/1991 Verhulst ..... H04N 13/337 349/15
2005/0105003 A1* 5/2005 Van Der Heijden ..... H04N 21/4316 348/565
2018/0184079 A1* 6/2018 Wang ..... G06T 7/0004
2019/0191153 A1* 6/2019 Speigle ..... G09G 5/10
2020/0327348 A1* 10/2020 Kim ..... G06K 9/00107
2021/0042546 A1* 2/2021 Kim ..... G06K 9/00107

FOREIGN PATENT DOCUMENTS

CN 1286067 C 11/2006
CN 104282251 A 1/2015
CN 108922463 A 11/2018

* cited by examiner

*Primary Examiner* — Gerald Johnson
(74) *Attorney, Agent, or Firm* — von Briesen & Roper, s.c.

(57) ABSTRACT

Provided are a residual image detection method and apparatus of a display panel, and a display device. The method includes: controlling a display panel to display a chessboard picture for a preset duration, controlling the display panel to display a pure color picture having a third grayscale, the pure color picture includes multiple pure color sub-pictures, and each of pure color sub-picture includes a middle area and multiple edge areas surrounding the middle area; detecting a luminance of each of the multiple edge areas in the pure color picture; and calculating the residual image quantization value of each of the multiple edge areas according to the luminance of each of the multiple edge areas and a formula, and determining a residual image quantization value of the display panel according to residual image quantization values of the multiple edge areas.

16 Claims, 5 Drawing Sheets

RESIDUAL IMAGE DETECTION METHOD AND APPARATUS OF DISPLAY PANEL

CROSS-REFERENCE TO RELATED APPLICATIONS

This application claims priority to Chinese patent application No. 202011045293.7 filed with CNIPA on Sep. 28, 2020, the disclosure of which is incorporated herein by reference in its entirety.

TECHNICAL FIELD

Embodiments of the present disclosure relate to the technical field of display technologies and, in particular, to a residual image detection method and apparatus of a display panel, and a display device.

BACKGROUND

Display defect detection is an indispensable part of the display industry, which has great significance for ensuring the quality of display panels and controlling production costs. There are various types of display defects, including luminance anomaly point defects, luminance anomaly line defects, residual images, etc. Among them, the residual images are characterized by irregular shapes and blurred edges, and thus are difficult to be detected accurately.

Since the conventional residual image detection is carried out by means of manual vision, whose accuracy is poor, residual image quantization has become an important manner for the residual image detection. However, the residual image quantization results in the related art are related to the luminance stability of the initial picture displayed before the chessboard picture, the luminance uniformity of the display panel itself, and the number of grids on the picture used in the calculation, etc., resulting in the poor accuracy of the final residual image quantization value.

SUMMARY

The present disclosure provides a residual image detection method and apparatus of a display panel, and a display device, so to improve the accuracy of the residual image quantization value.

In an embodiment, the present disclosure provides a residual image detection method of a display panel. The method includes the steps described below.

The display panel is controlled to display a chessboard picture for a preset duration; the chessboard picture includes multiple sub-pictures arranged in a matrix, the multiple sub-pictures includes multiple first sub-pictures and multiple second sub-pictures, each first sub-picture has a first grayscale, each second sub-picture has a second grayscale, and the multiple first sub-pictures and the multiple second sub-pictures are alternately arranged in both a row direction and a column direction of the matrix.

The display panel is controlled to display a pure color picture having a third grayscale; the third grayscale is between the first greyscale and the second greyscale, the pure color picture includes multiple pure color sub-pictures, each pure color sub-picture corresponds to a respective one sub-picture, a pure color sub-picture and a sub-picture corresponding to the pure color sub-picture are displayed by using pixels within a same area of the display panel, and each pure color sub-picture includes a middle area and multiple edge areas surrounding the middle area.

A luminance of each of the multiple edge areas in the pure color picture is detected.

A residual image quantization value of each of the multiple edge area is calculated according to the luminance of each of the multiple edge area and a formula; the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge.

A residual image quantization value of the display panel is determined according to residual image quantization values of the multiple edge areas.

In an embodiment, the present disclosure further provides a residual image detection apparatus of a display panel. The apparatus includes a first control display module, a second control display module, a luminance detection module, a calculation module, and a quantization value determination module.

The first control display module is configured to control the display panel to display a chessboard picture for a preset duration; the chessboard picture includes multiple sub-pictures arranged in a matrix, the multiple sub-pictures includes multiple first sub-pictures and multiple second sub-pictures, each first sub-picture has a first grayscale, each second sub-picture has a second grayscale, and the multiple first sub-pictures and the multiple second sub-pictures are alternately arranged in both a row direction and a column direction of the matrix.

The second control display module is configured to control the display panel to display a pure color picture having a third grayscale; the third grayscale is between the first greyscale and the second greyscale, the pure color picture includes multiple pure color sub-pictures, each pure color sub-picture corresponds to a respective one sub-picture, a pure color sub-picture and a sub-picture corresponding to the pure color sub-picture are displayed by using pixels within a same area of the display panel, and each pure color sub-pictures includes a middle area and multiple edge areas surrounding the middle area.

The luminance detection module is configured to detect a luminance of each of the multiple edge areas in the pure color picture.

The calculation module is configured to calculate a residual image quantization value of each of the multiple edge areas according to the luminance of each of the multiple edge areas and a formula; where the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge.

The quantization value determination module is configured to determine a residual image quantization value of the display panel according to residual image quantization values of the multiple edge areas.

In an embodiment, the present disclosure further provides a display device including the residual image detection apparatus of the display panel described in the above embodiments.

BRIEF DESCRIPTION OF DRAWINGS

Other features, objects and advantages of the present disclosure will become more apparent from a detailed description of non-restrictive embodiments with reference to the drawings.

DETAILED DESCRIPTION

Figure 1:
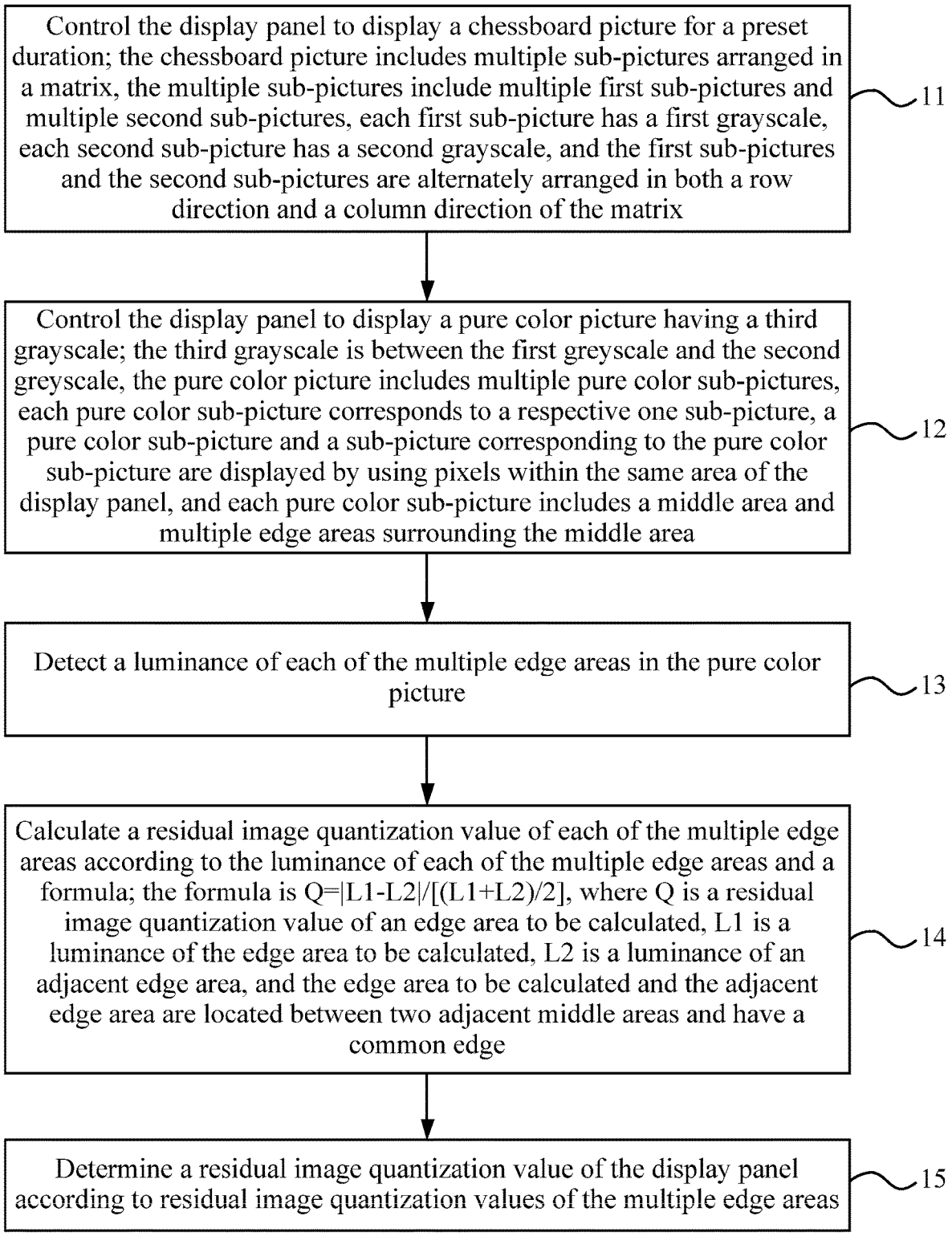
FIG. 1 is a flowchart of a residual image detection method of a display panel according to an embodiment of the present disclosure.

To elucidate technical means and technical effects for achieving an intended purpose of the present disclosure, embodiments, structures, features and effects of a residual image detection method and apparatus of a display panel and a display device according to the present disclosure are described hereinafter in detail with reference to the drawings and alternative embodiments.

The embodiments of the present disclosure provide a residual image detection method of a display panel. The method includes steps described below.

The display panel is controlled to display a chessboard picture for a preset duration;

the chessboard picture includes multiple sub-pictures arranged in a matrix, the multiple sub-pictures include multiple first sub-pictures and multiple second sub-pictures, each first sub-picture has a first grayscale, each second sub-picture has a second grayscale, and the first sub-pictures and the second sub-pictures are alternately arranged in both a row direction of the matrix and a column direction of the matrix.

The display panel is controlled to display a pure color picture having a third grayscale; where the third grayscale is between the first greyscale and the second greyscale, the pure color picture includes multiple pure color sub-pictures, each pure color sub-picture corresponds to a respective one sub-picture, a pure color sub-picture and a sub-picture corresponding to the pure color sub-picture are displayed by using pixels within a same area of the display panel, and each pure color sub-picture includes a middle area and multiple edge areas surrounding the middle area.

A luminance of each of the multiple edge areas in the pure color picture is detected.

A residual image quantization value of each of the multiple edge areas is calculated according to the luminance of each of the multiple edge areas and a formula; the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge.

A residual image quantization value of the display panel is determined according to residual image quantization values of the multiple edge areas.

In the technical schemes provided by the embodiments of the present disclosure, the display panel is controlled to display a chessboard picture for a preset duration; the display panel is controlled to display a pure color picture having a third grayscale, where the pure color picture includes multiple pure color sub-pictures, and each pure color sub-picture includes a middle area and multiple edge areas surrounding the middle area; a luminance of each edge area in the pure color picture is detected; the residual image quantization value of each of the multiple edge areas is calculated according to the luminance of each of the multiple edge areas and a formula, the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge; and a residual image quantization value of the display panel is determined according to residual image quantization values of the multiple edge areas, so that before displaying the chessboard picture, the display of the initial picture is not needed, thereby avoiding the residual image quantization value of the display panel to be affected by the stability of the initial picture. Furthermore, the edge areas in all pure color sub-pictures are involved in the calculation process. Therefore, in one aspect, the effect of the number of participating pure color sub-pictures on the residual image quantization value of the display panel is avoided, and in another aspect, the width of the edge areas actually involved in the calculation is relatively small, so the effect of the luminance uniformity of the display panel on the residual image quantization value of the display panel is relatively small in the present application, thereby improving the accuracy of the final residual image quantification value.

The preceding is the core idea of the present application. The technical schemes in embodiments of the present disclosure are described clearly and completely below in conjunction with the drawings in embodiments of the present disclosure. Apparently, the embodiments described below are a part, not all, of embodiments of the present disclosure. Based on the embodiments of the present disclosure, all other embodiments obtained by those skilled in the art without creative work are within the scope of the present disclosure.

Details are set forth below to facilitate a thorough understanding of the present disclosure. However, the present disclosure may be implemented by other embodiments different from the embodiments described herein, and those skilled in the art may make similar generalizations without departing from the intension of the present disclosure. Therefore, the present disclosure is not limited to the embodiments below.

For another, the present disclosure is described in detail in conjunction with the drawings. In the detailed description of embodiments of the present disclosure, for ease of description, schematic views illustrating structures of devices and components are not partially enlarged to a general proportional scale. The schematic views are merely illustrative and are not intended to limit the scope of the present disclosure. Additionally, actual manufacturing includes three-dimensional spatial sizes of length, width and height.

FIG. 1 is a flowchart of a residual image detection method of a display panel according to an embodiment of the present disclosure. The residual image detection method of the display panel is used for performing the detection on the residual image of the display panel to determine the residual image quantization value. As shown in FIG. 1, the residual image detection method of the display panel provided by the embodiments of the present disclosure may include the steps described below.

In step 11, the display panel is controlled to display a chessboard picture for a preset duration; the chessboard picture includes multiple sub-pictures arranged in a matrix, the multiple sub-pictures include multiple first sub-pictures and multiple second sub-pictures, each first sub-picture has a first grayscale, each second sub-picture has a second grayscale, and the first sub-pictures and the second sub-pictures are alternately arranged in both a row direction of the matrix and a column direction of the matrix.

Figure 2:
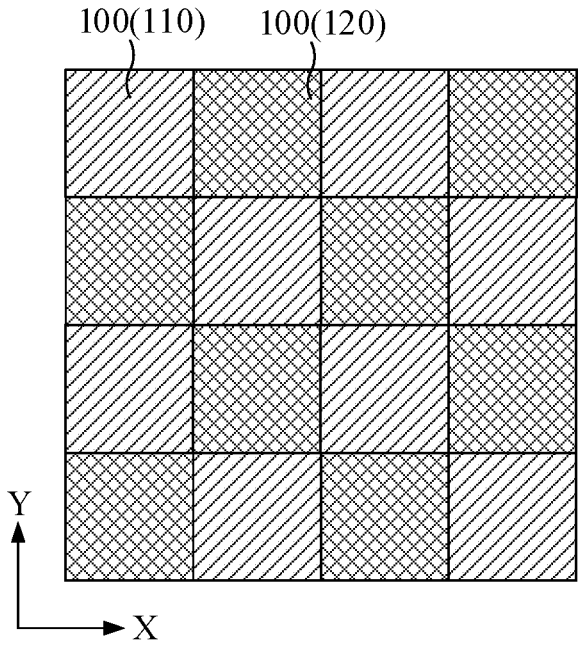
FIG. 2 is a schematic view of a chessboard picture according to an embodiment of the present disclosure.

FIG. 2 is a schematic view of a chessboard picture according to an embodiment of the present disclosure. As shown in FIG. 2, the chessboard picture includes multiple sub-pictures 100 arranged in a matrix, the multiple sub-pictures 100 include multiple first sub-pictures 110 and multiple second sub-pictures 120, each first sub-picture 110 has a first grayscale, each second sub-picture 120 has a second grayscale, and the first sub-pictures 110 and the second sub-pictures 120 are alternately arranged in both a row direction X of the matrix and a column direction Y of the matrix.

Exemplarily, the first grayscale may be grayscale 0 and the second grayscale may be grayscale 255. In this way, a grayscale difference between adjacent chessboards is the largest, which is beneficial to improve the contrast between the residual image position and other areas in the displayed pure color picture.

The preset duration for displaying the chessboard picture is not limited in this embodiment, and may be set reasonably according to actual requirements.

In step 12, the display panel is controlled to display a pure color picture having a third grayscale; the third grayscale is between the first greyscale and the second greyscale, the pure color picture includes multiple pure color sub-pictures, each pure color sub-picture corresponds to a respective one sub-picture, a pure color sub-picture and a sub-picture corresponding to the pure color sub-picture are displayed by using pixels within the same area of the display panel, and each pure color sub-picture includes a middle area and multiple edge areas surrounding the middle area.

Exemplarily, the third grayscale may be equal to a mean value of the first grayscale and the second grayscale. For example, if the first grayscale is grayscale 0 and the second grayscale is grayscale 254, the third grayscale is grayscale 127; or, if the first grayscale is 1 grayscale and the second grayscale is grayscale 255, the third grayscale is grayscale 128.

It is to be noted that the grayscale refers to the rank of the electromagnetic wave radiation strength of a ground object as expressed on the black-and-white image, and is the scale for dividing ground object spectrum features. The greyscale represents a level of different luminance from darkest to brightest. The more levels there are, the more delicate the picture effect that may be presented. For example, taking an 8-bit display screen as an example, this display screen may show 2 to the 8th power of luminance levels, that is, a total of 256 luminance levels, which is usually called grayscale 256, including grayscale 0 to grayscale 255. Therefore, the greyscale generally appears as an integer, and based on this, when the mean value of the first grayscale and the second grayscale is not an integer, a rounding operation may be performed on the mean value, so the obtained grayscale is taken as the third grayscale.

Figure 3:
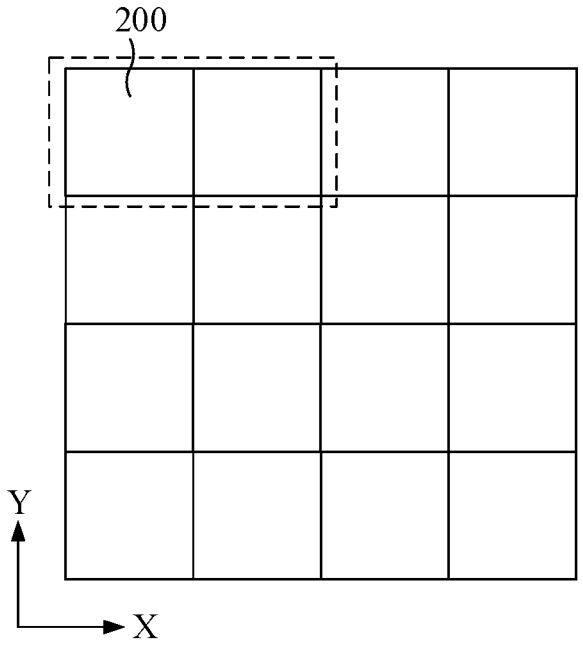
FIG. 3 is a schematic view of a pure color picture having a third grayscale according to an embodiment of the present disclosure.

FIG. 3 is a schematic view of a pure color picture having a third grayscale according to an embodiment of the present disclosure. As shown in FIG. 3, the pure color picture includes multiple pure color sub-pictures 200, each pure color sub-picture 200 corresponds to a respective one sub-picture 100 in FIG. 2, and a pure color sub-picture 200 and a sub-picture 100 corresponding to the pure color sub-picture 200 are displayed by using pixels within a same area of the display panel, that is, the pure color sub-picture 200 and the sub-picture 100 are in the same area of the display panel. A sub-picture 100 is displayed in the chessboard picture display phase, then in the pure color picture display phase, a pure color sub-picture 200 is displayed in the same area of the display panel.

Figure 4:
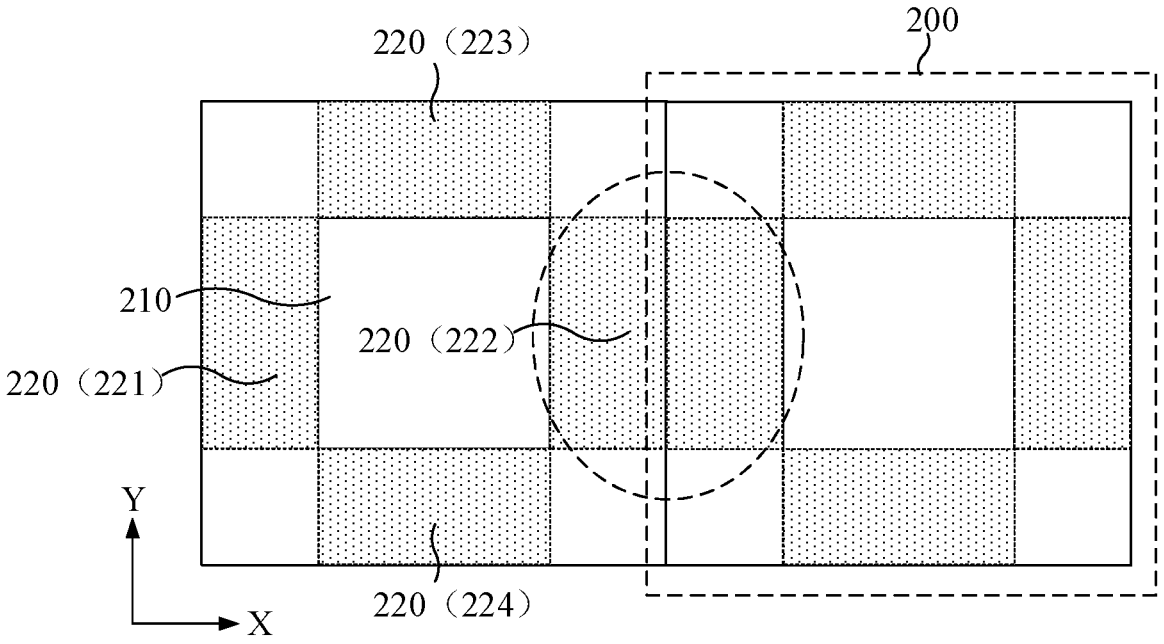
FIG. 4 is a schematic view of a structure within the dashed box in FIG. 3.

FIG. 4 is a schematic view of a structure within the dashed box in FIG. 3. As shown in FIG. 4, the pure color sub-picture 200 includes a middle area 210 and multiple edge areas 220.

In this way, if an area of the display panel is used for displaying a sub-picture in the chessboard picture display phase, this area is also used for displaying a pure color sub-picture in the pure color screen display phase.

The number of edge areas 220 in each pure color sub-picture 200 is not limited in this embodiment. In FIG. 3, this embodiment is described by taking a setting where a pure color sub-pixel 200 includes four edge areas 220 and each of the four edge areas 220 corresponds to one edge of the pure color sub-picture 200 as an example, and in other implementation modes of this embodiment, the number of edge areas 220 in the pure color sub-picture 200 may also be more than four, and each edge of the pure color sub-picture 200 may correspond to two or more edge areas. However, it is to be noted that two edge areas 220 having a common edge, which are in different pure color sub-pictures 200, have equal lengths in the vertical direction of their arrangement direction, and the two edge area are not misaligned.

Figure 5:
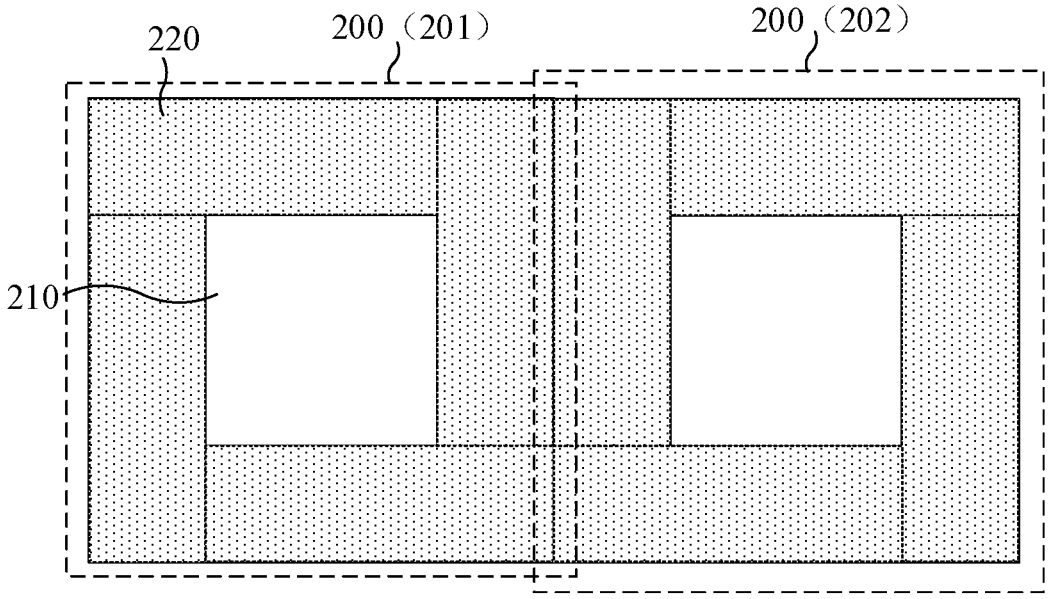
FIG. 5 is a schematic view of a contrast structure.

It is to be noted that if corner positions of the pure color sub-picture 200 are divided at the edge areas 220, as shown in FIG. 5, in order to ensure that two edge areas 220 having a common edge are not misaligned, adjacent pure color sub-pictures 200 use different area division manners. For example, an area of an upper left corner of the first pure color sub-picture 201 is divided within the edge area 220 on an upper side of the middle area 210, while an area of an upper left corner of the second pure color sub-picture 202 is divided within the edge area 220 on a left side of the middle area 210. In this embodiment, however, as shown in FIG. 4, any edge area 220 is located between two adjacent middle areas 210, and no edge area 220 is set at the corner positions of the pure color sub-picture 200, so that edge areas 220 corresponding to a same edge in each pure color sub-picture 200 have a same structure while ensuring that there is no misalignment of the two edge areas 220 having a common edge, and thus each pure color sub-picture 200 has a same area division manner, the difficulty of the area division design is simplified.

In step 13, a luminance of each of the multiple edge areas in the pure color picture is detected.

Exemplarily, the luminance of the edge area may be detected by using a conventional picture luminance detection apparatus. The luminance detection apparatus obtains an image of a pure color picture, extracts a luminance of each sub-pixel within an edge area of the image, and obtains a luminance of a corresponding edge area according to the luminance of each sub-pixel within the edge area, e.g., a mean value of the luminance of each sub-pixel within the edge area may be taken as the luminance of the edge area.

In step 14, a residual image quantization value of each of the multiple edge areas is calculated according to the luminance of each of the multiple edge areas and a formula; the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge.

Exemplarily, with continued reference to FIG. 4, one of two edge areas 220 located in the elliptical dashed frame in the figure is the edge area to be calculated, and the other is the adjacent edge area.

It is to be noted that the calculation by using the formula in this embodiment is carried out based on the mean value of two adjacent edge areas as well as an absolute value of the luminance difference. The calculation result is not directly related to the objective luminance of any edge area, and thus has higher accuracy.

In step 15, a residual image quantization value of the display panel is determined according to residual image quantization values of the multiple edge areas.

It is to be noted that the manner of determining the residual image quantization value of the display panel is not limited in this embodiment, and any method of obtaining the residual image quantization value of the display panel based on the residual image quantization values of the multiple edge areas is within the scope of this embodiment.

In the scheme provided by this embodiment, the display panel is controlled to display a chessboard picture for a preset duration; the display panel is controlled to display a pure color picture having a third grayscale, the pure color picture includes multiple pure color sub-pictures, and each pure color sub-picture includes a middle area and multiple edge areas surrounding the middle area; a luminance of each edge area in the pure color picture is detected; the residual image quantization value of each of the multiple edge areas is calculated according to the luminance of each of the multiple edge areas and a formula, the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge; and a residual image quantization value of the display panel is determined according to the residual image quantization values of the multiple edge areas, so that before displaying the chessboard picture, the display of the initial picture is not needed, thereby avoiding the residual image quantization value of the display panel to be affected by the stability of the initial picture. Furthermore, the edge areas in all pure color sub-pictures are involved in the calculation process. Therefore, in one aspect, the effect of the number of involved pure color sub-pictures on the residual image quantization value of the display panel is avoided, and in another aspect, the width of the edge areas actually involved in the calculation is relatively small, and then the effect of the luminance uniformity of the display panel on the residual image quantization value of the display panel is relatively small in the present application, so that the accuracy of the final residual image quantification value is improved.

A width y of each edge area 220 and a pixel density x of the display panel satisfy the following equation: $y=0.15\times-15$.

It is to be noted that the above equation is obtained based on a linear fit to the statistical results of big data. In the statistical process, a variety of different display panels having different pixel densities are selected as well as the best width of the edge area for each display panel, where the process of determining the best width of the edge area is as follows: a residual image quantization value is respectively calculated in a case of the width of the edge area equal to the width of n sub-pixels, where n is greater than or equal to 1 and is less than or equal to half of the number of sub-pixel columns in the pure color sub-picture, a residual image quantization value, which is neither too large nor too small and has a relatively small difference from a number of other residual image quantization values, is selected from the obtained residual image quantization values, and the edge area width used for calculating this selected residual image quantization value is taken as the best width. Then, a rectangular coordinate system is established by taking the pixel density of the display panel as the x-axis and the above-mentioned best width as the y-axis, a point corresponding to each display panel is respectively marked in the rectangular coordinate system, and the linear fit is performed on each point to obtain the above-relational equation. This experiment demonstrates that the fitting degree of the linear fit is up to 0.999, proving that the fitting is reasonable.

For an existing conventional display panel, the width of each edge area determined according to the above equation is usually the sum of widths of 1 to 20 sub-pixels.

With continued reference to FIG. 4, the multiple edge areas 220 include a first edge area 221, a second edge area 222, a third edge area 223, and a fourth edge area 224; along the row direction X of the matrix, the first edge area 221 and the second edge area 222 are located at opposite sides of the middle area 210; and along the column direction Y of the matrix, the third edge area 223 and the fourth edge area 224 are located at opposite sides of the middle area 210.

In this way, each edge of the pure color sub-picture 200 corresponds to an edge area 220, so that the total number of edge areas 220 is minimum while ensuring that the luminance of each sub-pixel near each edge is involved in the calculation of the residual image quantization value and each pure color sub-picture 200 use a same area division manner, thereby conducive to improving the accuracy of the residual image quantization value and reducing the calculation complexity.

The step that the residual image quantization value of the display panel is determined according to the residual image quantization values of the multiple edge areas may include steps described below. A residual image quantification value table of edge areas is constructed according to the residual image quantization values of the multiple edge areas, and the residual image quantization value of the display panel is determined according to the residual image quantification value table.

Exemplarily, when the pure color sub-picture has a same area division manner as the pure color sub-picture in FIG. 4, the residual image quantization value table corresponding to FIG. 2 and FIG. 3, for example, may be Table 1. The pure color picture in FIG. 3 includes four rows and four columns of pure color sub-pictures. An edge area having no adjacent edge area has no residual image quantization value, and is identified by using "I" in Table 1. The residual image quantization value of a left edge area of the pure color sub-picture in an $n^{th}$ row and mth column is recorded in a cell of n-m-1 in Table 1, the residual image quantization value of an upper edge area of the pure color sub-picture in the $n^{th}$ row and mth column is recorded in a cell of n-m-2 in Table 1, the residual image quantization value of a lower edge area of the pure color sub-picture in the $n^{th}$ row and mth column is recorded in a cell of n-m-3 in Table 1, and the residual image quantization value of a right edge area of the pure color sub-picture in the $n^{th}$ row and mth column is recorded in a cell of n-m-4 in Table 1, where n is a positive integer greater than or equal to 1 and less than or equal to 4, and m is a positive integer greater than or equal to 1 and less than or equal to 4.

TABLE 1

| Residual image quantization value | | | | | | | | |
|---|---|---|---|---|---|---|---|---|
| | Row | | | | | | | |
| Column | 1 | | 2 | | 3 | | 4 | |
| 1 | 1-1-1 | 1-1-2 | 2-1-1 | 2-1-2 | 3-1-1 | 3-1-2 | 4-1-1 | 4-1-2 |
| | 1-1-3 | 1-1-4 | 2-1-3 | 2-1-4 | 3-1-3 | 3-1-4 | 4-1-3 | 4-1-4 |
| 2 | 1-2-1 | 1-2-2 | 2-2-1 | 2-2-2 | 3-2-1 | 3-2-2 | 4-2-1 | 4-2-2 |
| | 1-2-3 | 1-2-4 | 2-2-3 | 2-2-4 | 3-2-3 | 3-2-4 | 4-2-3 | 4-2-4 |
| 3 | 1-3-1 | 1-3-2 | 2-3-1 | 2-3-2 | 3-3-1 | 3-3-2 | 4-3-1 | 4-3-2 |
| | 1-3-3 | 1-3-4 | 2-3-3 | 2-3-4 | 3-3-3 | 3-3-4 | 4-3-3 | 4-3-4 |
| 4 | 1-4-1 | 1-4-2 | 2-4-1 | 2-4-2 | 3-4-1 | 3-4-2 | 4-4-1 | 4-4-2 |
| | 1-4-3 | 1-4-4 | 2-4-3 | 2-4-4 | 3-4-3 | 3-4-4 | 4-4-3 | 4-4-4 |

It is to be noted that the construction of the residual image quantification value table of edge areas can facilitate the user to gain a more intuitive understanding of the residual image, and the user may extract the residual image quantization value table as needed.

The step that the residual image quantization value of the display panel is determined according to the residual image quantization values of the multiple edge areas may include steps described below, a maximum value is extracted from the residual image quantization values of the multiple edge areas, and the maximum value is taken as the residual image quantization value of the display panel.

Exemplarily, with continued reference to Table 1, the maximum residual image quantization value in the table, for example, is the value in a cell of 1-4-2, this value is extracted and taken as the residual image quantization value of the display panel.

It is to be understood that the maximum value in the residual image quantization values of the multiple edge areas represents the residual image situation in the edge area where the residual image is most severe, and using this value as the residual image quantization value of the display panel can avoid underestimating the residual image level of the display panel. Furthermore, after the maximum value is directly extracted from the residual image quantization values of the multiple edge areas, the residual image quantization value of the display panel can be obtained without calculation, which is conducive to reducing the complexity in the process of determining the residual image quantization value of the display panel.

The step that the residual image quantization value of the display panel is determined according to the residual image quantization values of the multiple edge areas includes steps described below, a first mean value of residual image quantification values of the first edge area and the second edge area which are in each pure color sub-picture, and a second mean value of residual image quantification values of the third edge area and the fourth edge area which are in each pure color sub-picture are calculated, a maximum value is extracted from multiple first mean values and multiple second mean values, and the maximum value is taken as the residual image quantization value of the display panel.

Exemplarily, mean values of values in cells of n-m-1 and n-m-3 and mean values of values in cells of n-m-2 and n-m-4 in Table 1 are calculated, and the maximum value in all these mean values obtained from the calculation is taken as the residual image quantization value of the display panel.

It is to be noted that when the maximum value in multiple first mean values and multiple second mean values is taken as the residual image quantization value of the display panel, the residual image quantization value of the display panel is related to two edge areas, so that the accuracy of the determined residual image quantization value of the display panel is higher.

The step that the residual image quantization value of the display panel is determined according to the residual image quantization values of the multiple edge areas includes steps described below, a mean value of residual image quantization values of the four edge areas in each pure color sub-picture is calculated, a maximum value is extracted from multiple mean values, and the maximum value is taken as the residual image quantization value of the display panel.

Exemplarily, mean values of values in cells of n-m-1, n-m-3, n-m-2, and n-m-4 in Table 1 are calculated, and the maximum value in all these mean values obtained from the calculation is taken as the residual image quantization value of the display panel.

It is to be noted that when the maximum value in the multiple mean values is taken as the residual image quantization value of the display panel, the residual image quantization value of the display panel is related to four edge areas, which further improves the accuracy of the residual image quantization value of the display panel.

In this embodiment, after the residual image quantization value of the display panel is determined according to the residual image quantization values of the multiple edge areas, the method may further include steps described below, a residual image grade classification rule is acquired, and a first residual image grade of the display panel is determined according to the residual image quantization value of the display panel and the residual image grade classification rule.

It is to be noted that the residual image grade indicates the severity of the residual image, and the higher the residual image grade, the more severe the residual image. The grade classification rule includes ranges of residual image quantification values corresponding to different residual image grades. For example, the residual image grade is classified into three grades, that is, a first grade, a second grade, and a third grade in which the residual image severity successively increases, where a range of the residual image quantification value corresponding to the first grade is $A \le a \le B$, a range of the residual image quantification value corresponding to the second grade is $B < a \le C$, and a range of the residual image quantification value corresponding to the third grade is $C < a \le D$. When the calculated residual image quantification value of the display panel is within any of the above ranges, the residual image grade of the display panel is determined to be the corresponding grade. For example, the residual image quantization value of the display panel is equal to E, and $B < E \le C$, so the residual image grade of the display panel is determined to be the second grade.

The residual image classification rule may be determined according to empirical data, or determined by an experimental big data summary rule. Therefore, results of residual image standards of the display panel determined by the residual image classification rule and the residual image quantification value of the display panel are accurate and objective, and the quality of display panels which are finally classified into a same grade is equivalent.

Exemplarily, after the residual image quantization value of the display panel is determined according to the residual image quantization values of the multiple edge areas, the method may further include steps described below, a boundary line of the smallest rectangular area in which at least one edge area corresponding to the residual image quantization value of the display panel is located is determined, and the boundary line is displayed in the pure color picture.

The boundary line may be displayed in such a way that a luminescence color of each sub-pixel on the boundary line is adjusted to a specific color.

It is to be understood that for the case where the maximum value of the residual image quantization values of the multiple edge areas is taken as the residual image quantization value of the display panel, a number of edge areas corresponding to the residual image quantization value of the display panel is one, i.e., the edge area corresponding to this maximum value. For the case where the residual image quantization values of the edge areas located at opposite sides of the middle area in a same pure color sub-picture are averaged and the maximum value of all the mean values is determined as the residual image quantization value of the display panel, the number of edge areas corresponding to the residual image quantization value of the display panel is two, i.e., two edge areas corresponding to this maximum value. For the case where the residual image quantization values of four edge areas in the same pure color sub-picture are averaged and the maximum value of all the mean values is determined as the residual image quantization value of the display panel, the number of edge areas corresponding to the residual image quantization value of the display panel is four, i.e., four edge areas corresponding to this maximum value.

Figure 6:
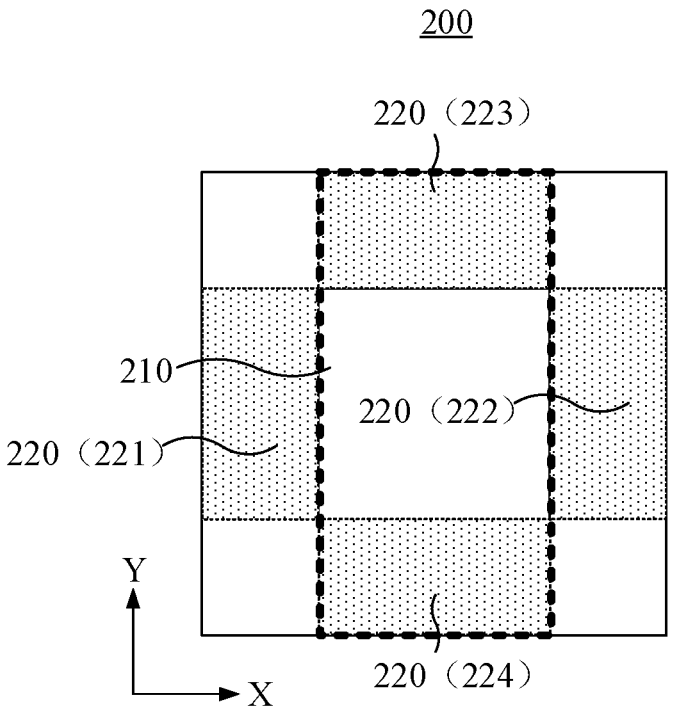
FIG. 6 is a structural view of a pure color sub-picture according to an embodiment of the present disclosure.
Figure 7:
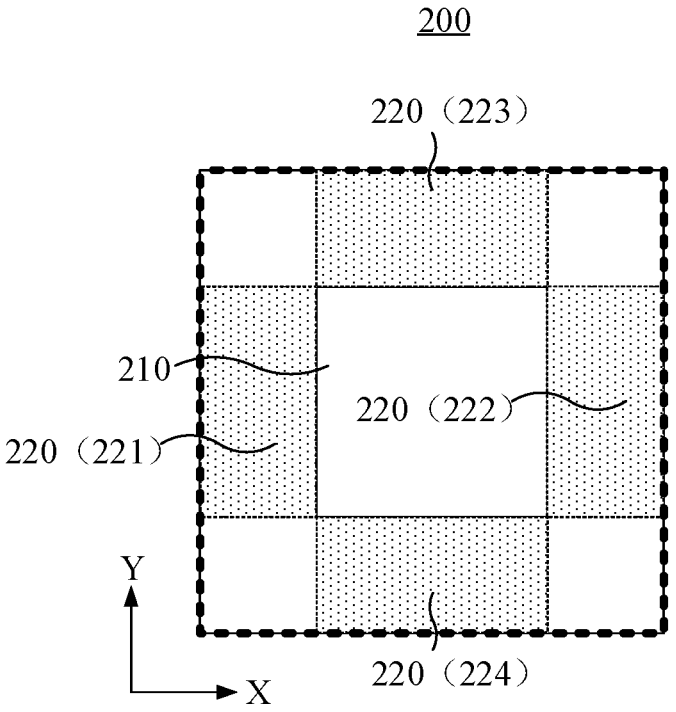
FIG. 7 is a structural view of another pure color sub-picture according to an embodiment of the present disclosure.

Exemplarily, when the number of edge areas corresponding to the residual image quantization value of the display panel is one, an edge of this edge area is the boundary line of the smallest rectangular area in which this edge area is located. When the number of edge areas corresponding to the residual image quantization value of the display panel is two, the smallest rectangle in which these two edge areas are located is the one having the smallest area among all rectangles including the two edge areas. As shown in FIG. 6, the bold dashed rectangle is the smallest rectangle including two edge areas. When the number of edge areas corresponding to the residual image quantization value of the display panel is four, the smallest rectangle in which the four edge areas are located is the one having the smallest area among all rectangles including the four edge areas. As shown in FIG. 7, the bold dashed rectangle is the smallest rectangle including four edge areas, and overlaps the pure color sub-picture 200 where the four edge areas are located.

It is to be noted that the residual image level of each edge area corresponding to the residual image quantization value of the display panel is the highest, then an area in which these edge areas are located is the area in which the residual image is most severe in the display panel, edges of the corresponding smallest rectangle are displayed such that human eyes can quickly identify the area with the most severe residual image and the residual image situation can be known.

After the first residual image grade of the display panel is determined, the method may further include steps described below, a second residual image grade input by a user is received, it is judged whether the second residual image grade is the same as the first residual image grade, and when the second residual image grade is the same as the first residual image grade, a value of the first residual image grade is displayed at a preset position on the pure color picture.

Figure 8:
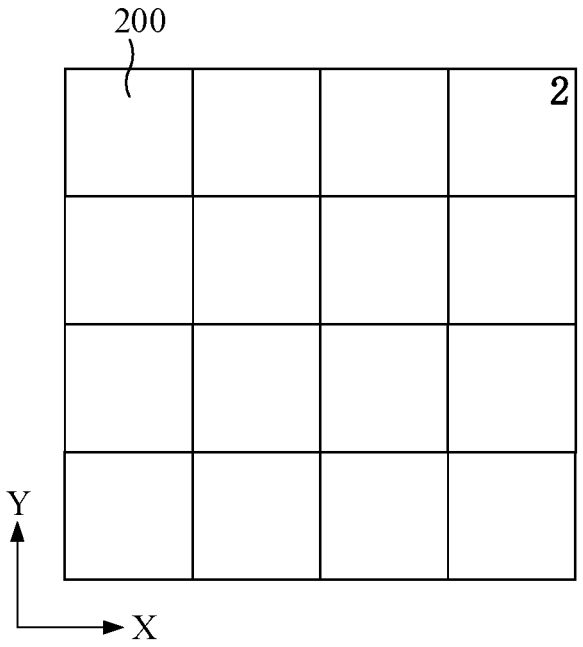
FIG. 8 is a structural view of another pure color picture according to an embodiment of the present disclosure.

When the second residual image grade input by the user is the same as the first residual image grade obtained through the calculation, it represents that the first residual image grade has higher accuracy. In order to help the user understand the image quality of the display panel, the value of the first residual image grade is displayed at the preset position on the pure color picture. The preset position may be, for example, a corner of the pure color picture to reduce the effect of the value of the first residual image grade on the quality of the pure color picture. In addition, the display form of the value of the first residual image grade is not limited herein, for example, it may be displayed in a form of Arabic numerals, or letters, or Chinese characters. Exemplarily, FIG. 8 is a structural view of another pure color picture according to an embodiment of the present disclosure. As shown in FIG. 8, the value of the first residual image grade in the form of Arabic number "2" is shown at an upper right corner of the pure color picture, which means that the first residual image grade and the second residual image grade is the same, and both are grade 2.

The second residual image grade input by the user is the residual image grade of the display panel determined by the user based on human eyes, and this method is the existing conventional way of determining the residual image grade of the display panel, and will not be repeated herein.

In another aspect, if the second residual image grade is different from the first residual image grade, it is prompted that the residual image grade is incorrectly determined.

When the second residual image grade input by the user is different from the first residual image grade obtained through the calculation, it indicates that the first residual image grade is possibly inaccurate and further verification is required, and in this case, the user should be prompted. The manner for prompting that residual image grade is incorrectly determined may be, for example, an audio-visual prompt, a simple sound prompt, or a textual prompt, which is not limited by this embodiment.

It is to be understood that the second residual image grade determined by the user's eyes may not be accurate, therefore the fact that the second residual image grade is different from the first residual image grade does not mean that the first residual image grade is definitely wrong, but it only means a possibility that it is wrong, so what the user receives is actually a prompt to do further verification of the residual image grade.

Figure 9:
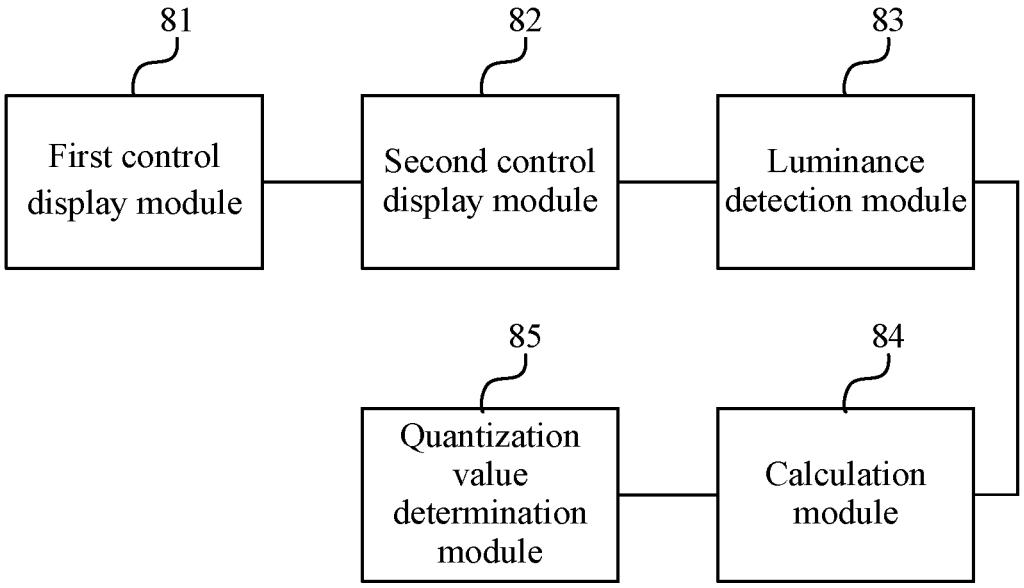
FIG. 9 is a structural view of a residual image detection apparatus of a display panel according to an embodiment of the present disclosure.

FIG. 9 is a structural view of a residual image detection apparatus of a display panel according to an embodiment of the present disclosure. As shown in FIG. 9, the residual image detection apparatus for the display panel may include a first control display module 81, a second control display module 82, a luminance detection module 83, a calculation module 84 and a quantization value determination module 85.

The first control display module 81 is configured to control the display panel to display a chessboard picture for a preset duration; the chessboard picture includes multiple sub-pictures arranged in a matrix, the multiple sub-pictures include multiple first sub-pictures and multiple second sub-pictures, each first sub-picture has a first grayscale, each second sub-picture has a second grayscale, and the first sub-pictures and the second sub-pictures are alternately arranged in both a row direction and a column direction of the matrix.

The second control display module 82 is configured to control the display panel to display a pure color picture having a third grayscale; the third grayscale is between the first greyscale and the second greyscale, the pure color picture includes multiple pure color sub-pictures, each pure color sub-picture corresponds to a respective one sub-picture, a pure color sub-picture and a sub-picture corresponding to the pure color sub-picture are displayed by using pixels within a same area of the display panel, and each pure color sub-picture includes a middle area and multiple edge areas surrounding the middle area.

The luminance detection module 83 is configured to detect a luminance of each of the multiple edge areas in the pure color picture.

The calculation module 84 is configured to calculate a residual image quantization value of each of the multiple edge areas according to the luminance of each of the multiple edge areas and a formula; the formula is $Q=|L1-L2|/[(L1+L2)/2]$, where Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge.

The quantization value determination module 85 is configured to determine a residual image quantization value of the display panel according to residual image quantization values of the multiple edge areas.

In this embodiment, the multiple edge areas include a first edge area, a second edge area, a third edge area, and a fourth edge area; along the row direction of the matrix, the first edge area and the second edge area are located at opposite sides of the middle area; and along the column direction of the matrix, the third edge area and the fourth edge area are located at opposite sides of the middle area.

Accordingly, the quantization value determination module may include a maximum value extraction unit and a first quantization value determination unit.

The maximum value extraction unit is configured to extract a maximum value from the residual image quantization values of the multiple edge areas.

The first quantization value determination unit is configured to take the maximum value as the residual image quantization value of the display panel.

In this embodiment, the multiple edge areas include a first edge area, a second edge area, a third edge area, and a fourth edge area; along the row direction of the matrix, the first edge area and the second edge area are located at opposite sides of the middle area; and along the column direction of the matrix, the third edge area and the fourth edge area are located at opposite sides of the middle area.

Accordingly, the quantization value determination module may include a first mean value calculation unit, a second maximum value extraction unit and a second quantization value determination unit.

The first mean value calculation unit is configured to calculate a first mean value of residual image quantification values of the first edge area and the second edge area which are in each pure color sub-picture, and a second mean value of residual image quantification values of the third edge area and the fourth edge area which are in each pure color sub-picture.

The second maximum value extraction unit is configured to extract a maximum value from multiple first mean values and multiple second mean values.

The second quantization value determination unit is configured to take the maximum value as the residual image quantization value of the display panel.

In this embodiment, the multiple edge areas include a first edge area, a second edge area, a third edge area, and a fourth edge area; along the row direction of the matrix, the first edge area and the second edge area are located at opposite sides of the middle area; and along the column direction of the matrix, the third edge area and the fourth edge area are located at opposite sides of the middle area.

Accordingly, the quantization value determination module may include a second mean value calculation unit, a third maximum value extraction unit and a third quantization value determination unit.

The second mean value calculation unit is configured to calculate a mean value of residual image quantization values of the four edge areas in each pure color sub-picture.

The third maximum value extraction unit is configured to extract a maximum value from multiple mean values.

The third quantization value determination unit is configured to take the maximum value as the residual image quantization value of the display panel.

In this embodiment, the residual image detection apparatus of the display panel may further include a classification rule acquisition module and a grade determination module.

The classification rule acquisition module is configured to acquire a residual image grade classification rule, after the residual image quantization value of the display panel is determined according to the residual image quantization values of the multiple edge areas.

The grade determination module is configured to determine a first residual image grade of the display panel according to the residual image quantization value of the display panel and the residual image grade classification rule.

It is to be noted that the above are merely preferred embodiments of the present disclosure and the technical principles used therein. It is to be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail via the preceding embodiments, the present disclosure is not limited to the preceding embodiments and may include other equivalent embodiments without departing from the concept of the present disclosure. The scope of the present disclosure is determined by the scope of the appended claims.

What is claimed is:

1. A residual image detection method of a display panel, comprising:

controlling the display panel to display a chessboard picture for a preset duration; wherein the chessboard picture comprises a plurality of sub-pictures arranged in a matrix, the plurality of sub-pictures comprise a plurality of first sub-pictures and a plurality of second sub-pictures, each of the plurality of first sub-pictures has a first grayscale, each of the plurality of second sub-pictures has a second grayscale, and the plurality of first sub-pictures and the plurality of second sub-pictures are alternately arranged in both a row direction and a column direction of the matrix;

controlling the display panel to display a pure color picture having a third grayscale; wherein the third grayscale is between the first greyscale and the second greyscale, the pure color picture comprises a plurality of pure color sub-pictures, each of the plurality of pure color sub-pictures corresponds to a respective one of the plurality of sub-pictures, a pure color sub-picture and a sub-picture corresponding to the pure color sub-picture are displayed by using pixels within a same area of the display panel, and each of the plurality of pure color sub-pictures comprises a middle area and a plurality of edge areas surrounding the middle area;

detecting a luminance of each of the plurality of edge areas in the pure color picture;

calculating a residual image quantization value of each of the plurality of edge areas according to the luminance of each of the plurality of edge areas and a formula; wherein the formula is $Q=|L1-L2|/[(L1+L2)/2]$, and wherein Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge; and determining a residual image quantization value of the display panel according to residual image quantization values of the plurality of edge areas.

2. The method of claim 1, wherein a width y of each edge area and a pixel density x of the display panel satisfy the following equation: $y=0.15\times-15$.

3. The method of claim 1, wherein the plurality of edge areas comprise a first edge area, a second edge area, a third edge area, and a fourth edge area; and along the row direction of the matrix, the first edge area and the second edge area are located at opposite sides of the middle area; and along the column direction of the matrix, the third edge area and the fourth edge area are located at opposite sides of the middle area.

4. The method of claim 3, wherein determining the residual image quantization value of the display panel according to the residual image quantization values of the plurality of edge areas comprises:

extracting a maximum value from the residual image quantization values of the plurality of edge areas; and taking the maximum value as the residual image quantization value of the display panel.

5. The method of claim 3, wherein determining the residual image quantization value of the display panel according to the residual image quantization values of the plurality of edge areas comprises:

calculating a first mean value of residual image quantification values of the first edge area and the second edge area which are in each of the plurality of pure color sub-pictures, and a second mean value of residual image quantification values of the third edge area and the fourth edge area which are in each of the plurality of pure color sub-pictures;

extracting a maximum value from a plurality of first mean values and a plurality of second mean values; and taking the maximum value as the residual image quantization value of the display panel.

6. The method of claim 3, wherein determining the residual image quantization value of the display panel according to the residual image quantization values of the plurality of edge areas comprises:

calculating a mean value of residual image quantization values of the four edge areas in each of the plurality of pure color sub-pictures;

extracting a maximum value from a plurality of mean values; and taking the maximum value as the residual image quantization value of the display panel.

7. The method of claim 1, after determining the residual image quantization value of the display panel according to the residual image quantization values of the plurality of edge areas, further comprising:

acquiring a residual image grade classification rule; and determining a first residual image grade of the display panel according to the residual image quantization value of the display panel and the residual image grade classification rule.

8. The method of claim 1, after determining the residual image quantization value of the display panel according to the residual image quantization values of the plurality of edge areas, further comprising:

determining a boundary line of a smallest rectangular area in which at least one edge area corresponding to the residual image quantization value of the display panel is located; and displaying the boundary line in the pure color picture.

9. The method of claim 7, after determining the first residual image grade of the display panel, further comprising:

receiving a second residual image grade input by a user; and judging whether the second residual image grade is the same as the first residual image grade, and in response to determining that the second residual image grade is the same as the first residual image grade, displaying a value of the first residual image grade at a preset position on the pure color picture.

10. The method of claim 9, further comprising:

in response to determining that the second residual image grade is different from the first residual image grade, prompting to redetect a residual image grade of the display panel.

11. The method of claim 1, wherein determining the residual image quantization value of the display panel according to the residual image quantization values of the plurality of edge areas comprises:

constructing a residual image quantification value table of edge areas according to the residual image quantization values of the plurality of edge areas; and determining the residual image quantization value of the display panel according to the residual image quantification value table.

12. A residual image detection apparatus of a display panel, comprising:

a first control display module, which is configured to control the display panel to display a chessboard picture for a preset duration; wherein the chessboard picture comprises a plurality of sub-pictures arranged in a matrix, the plurality of sub-pictures comprise a plurality of first sub-pictures and a plurality of second sub-pictures, each of the plurality of first sub-pictures has a first grayscale, each of the plurality of second sub-pictures has a second grayscale, and the plurality of first sub-pictures and the plurality of second sub-pictures are alternately arranged in both a row direction and a column direction of the matrix;

a second control display module, which is configured to control the display panel to display a pure color picture having a third grayscale; wherein the third grayscale is between the first greyscale and the second greyscale, the pure color picture comprises a plurality of pure color sub-pictures, each of the plurality of pure color sub-pictures corresponds to a respective one of the plurality of sub-pictures, a pure color sub-picture and a sub-picture corresponding to the pure color sub-picture are displayed by using pixels within a same area of the display panel, and each of the plurality of pure color sub-pictures comprises a middle area and a plurality of edge areas surrounding the middle area;

a luminance detection module, which is configured to detect a luminance of each of the plurality of edge areas in the pure color picture;

a calculation module, which is configured to calculate a residual image quantization value of each of the plurality of edge areas according to the luminance of each of the plurality of edge areas and a formula; wherein the formula is $Q=|L1-L2|/[(L1+L2)/2]$, and wherein Q is a residual image quantization value of an edge area to be calculated, L1 is a luminance of the edge area to be calculated, L2 is a luminance of an adjacent edge area, and the edge area to be calculated and the adjacent edge area are located between two adjacent middle areas and have a common edge; and a quantization value determination module, which is configured to determine a residual image quantization value of the display panel according to residual image quantization values of the plurality of edge areas.

13. The apparatus of claim 12, wherein the plurality of edge areas comprises a first edge area, a second edge area, a third edge area, and a fourth edge area; along the row direction of the matrix, the first edge area and the second edge area are located at opposite sides of the middle area; and along the column direction of the matrix, the third edge area and the fourth edge area are located at opposite sides of the middle area; and the quantization value determination module comprises:

a maximum value extraction unit, which is configured to extract a maximum value from the residual image quantization values of the plurality of edge areas; and a first quantization value determination unit, which is configured to take the maximum value as the residual image quantization value of the display panel.

14. The apparatus of claim 12, wherein the plurality of edge areas comprises a first edge area, a second edge area, a third edge area, and a fourth edge area; along the row direction of the matrix, the first edge area and the second edge area are located at opposite sides of the middle area; and along the column direction of the matrix, the third edge area and the fourth edge area are located at opposite sides of the middle area; and the quantization value determination module comprises:

a first mean value calculation unit, which is configured to calculate a first mean value of residual image quantification values of the first edge area and the second edge area which are in each of the plurality of pure color sub-pictures, and a second mean value of residual image quantification values of the third edge area and the fourth edge area which are in each of the plurality of pure color sub-pictures;

a second maximum value extraction unit, which is configured to extract a maximum value from a plurality of first mean values and a plurality of second mean values; and a second quantization value determination unit, which is configured to take the maximum value as the residual image quantization value of the display panel.

15. The apparatus of claim 12, wherein the plurality of edge areas comprises a first edge area, a second edge area, a third edge area, and a fourth edge area; along the row direction of the matrix, the first edge area and the second edge area are located at opposite sides of the middle area; and along the column direction of the matrix, the third edge area and the fourth edge area are located at opposite sides of the middle area; and the quantization value determination module comprises:

a second mean value calculation unit, which is configured to calculate a mean value of residual image quantization values of the four edge areas in each of the plurality of pure color sub-pictures;

a third maximum value extraction unit, which is configured to extract a maximum value from a plurality of mean values; and a third quantization value determination unit, which is configured to take the maximum value as the residual image quantization value of the display panel.

16. The apparatus of claim 12, further comprising:

a classification rule acquisition module, which is configured to, after the residual image quantization value of the display panel is determined according to the residual image quantization values of the plurality of edge areas, acquire a residual image grade classification rule; and a grade determination module, which is configured to determine a first residual image grade of the display panel according to the residual image quantization value of the display panel and the residual image grade classification rule.

* * * * *